US005641080A

United States Patent [19]

Humphrey et al.

[11] Patent Number: 5,641,080

[45] Date of Patent: Jun. 24, 1997

[54] CAROUSEL STORAGE ASSEMBLY

[75] Inventors: David C. Humphrey, Fremont; Douglas F. Wolff, Marshall; Theodis C. Davis, Norton Shores, all of Mich.

[73] Assignee: Gerber Products Company, Fremont, Mich.

[21] Appl. No.: 447,538

[22] Filed: May 24, 1995

[51] Int. Cl.[6] ..... A47F 5/00

[52] U.S. Cl. ..... 211/77; 211/163; 211/188; 248/633

[58] Field of Search ..... 211/77, 78, 163, 211/188, 194; 248/687, 633

[56] References Cited

U.S. PATENT DOCUMENTS

| | | | |
|---|---|---|---|
| D. 92,939 | 8/1934 | Albert . | |
| D. 204,113 | 3/1966 | Cranfill et al. | D83/1 |
| D. 209,848 | 1/1968 | Berend | D44/6 |
| D. 212,109 | 8/1968 | Taylor | D44/6 |
| D. 239,575 | 4/1976 | Powell, Jr. | D87/8.4 |
| D. 248,201 | 6/1978 | Kelley | D7/2 |
| D. 256,871 | 9/1980 | Snyder | D7/2 |
| D. 259,230 | 5/1981 | Snyder | D7/2 |
| D. 263,528 | 3/1982 | Gunnigle | D6/146 |
| D. 312,554 | 12/1990 | Daenen et al. | D7/501 |
| D. 333,744 | 3/1993 | Zimmerman | D6/457 |
| D. 334,873 | 4/1993 | Ancona et al. | D7/616 |
| 2,062,807 | 12/1936 | Cramer | 211/77 |
| 2,074,564 | 3/1937 | Scurlock | 211/77 |
| 2,281,849 | 5/1942 | McCoppin | 211/74 |
| 2,470,749 | 5/1949 | Randall | 211/146 |
| 2,600,922 | 6/1952 | Roldolfa | 308/227 |
| 2,657,809 | 11/1953 | Balch | 211/57 |
| 2,914,275 | 11/1959 | Mitchell | 248/633 |
| 2,914,793 | 12/1959 | McMahan | 16/161 |
| 2,946,456 | 7/1960 | Liquori | 211/77 |
| 3,139,189 | 6/1964 | Kolarik | 211/131 |
| 3,385,465 | 5/1968 | Bliss | 220/23.4 |
| 3,397,805 | 8/1968 | Berend | 220/23.86 |
| 3,858,529 | 1/1975 | Salladay | 108/103 |
| 4,082,046 | 4/1978 | Baglin | 108/106 |
| 4,140,223 | 2/1979 | Rau et al. | 211/78 |
| 4,438,853 | 3/1984 | Numbers | 211/77 |
| 4,579,473 | 4/1986 | Brugger | 403/163 |
| 4,643,104 | 2/1987 | Rasmussen | 108/105 |
| 4,762,237 | 8/1988 | Newton | 211/115 |
| 4,775,055 | 10/1988 | Morse | 211/78 |
| 4,909,400 | 3/1990 | Dubinsky | 211/163 X |
| 4,953,719 | 9/1990 | Spamer | 211/188 |
| 4,961,506 | 10/1990 | Lang | 211/188 |
| 4,964,520 | 10/1990 | Kilmartin, III | 211/131 |
| 5,101,738 | 4/1992 | Sideris | 108/94 |
| 5,117,989 | 6/1992 | Ross | 211/144 |
| 5,183,165 | 2/1993 | Acona et al. | 211/77 |
| 5,253,594 | 10/1993 | Sideris | 108/94 |
| 5,343,816 | 9/1994 | Sideris | 108/94 |
| 5,385,397 | 1/1995 | Chow | 211/163 X |

FOREIGN PATENT DOCUMENTS 2659721 9/1991 France .

OTHER PUBLICATIONS

Photocopy of packaging for Fisher–Price Baby Food Carousel, ©1991, 1994.

Photocopy of packaging for Pansy Ellen BabySusan Revolving Baby Food Organizer, ©1991.

*Primary Examiner*—Robert W. Gibson, Jr.

*Attorney, Agent, or Firm*—Price, Heneveld, Cooper, DeWitt & Litton

[57] ABSTRACT

A carousel storage assembly for jars, bottles and containers, and especially baby food jars, powdered formula containers, nurser bottles and the like. The assembly includes a first tray rotatably supported on bearings on a base, and at least one of a second tray or rack removably mounted on the first tray on spaced, bendable legs engaging leg retaining clips on the perimeter of the first tray. Preferably, a pair of the second trays, and a rack with container locating apertures therein, are successively stacked one on another on the first tray. The second trays include spaced, bendable legs and leg engaging clips, while the rack includes bendable legs. The assembly may be disassembled for storage or selective use of the trays and/or rack.

36 Claims, 3 Drawing Sheets

CAROUSEL STORAGE ASSEMBLY

BACKGROUND OF THE INVENTION

This invention relates to storage and shelf assemblies for jars, bottles, containers, and the like, especially for food, such as baby food jars, nurser bottles, and formula containers and, more particularly, to a rotatable storage assembly including one or more storage trays or racks which may be selectively stacked to form a multiple level assembly, used individually or in various combinations.

Rotatable storage racks and trays for foods, containers, and other items such as screws, nails, washers, and the like, typically known as "lazy susans," are widely known. A large variety of such shelves and racks have been proposed in the past, some including multiple shelves or racks. However, these prior known racks and shelves have often been unable to hold a sufficient number of containers to make them sufficient for use in the home such as by mothers who use a large quantity of baby food or baby formula in nursing bottles everyday. In many homes with babies, as many as 50 to 70 jars of baby food are typically stored at any one time for use by a family. Prior known storage racks or shelves have typically only held between 15 and 25 jars, thereby making the selection of readily available baby food on the counter top less than adequate for mediate use and requiring more inconvenient storage in less accessible cupboards and pantries.

Another problem encountered with prior known shelves and storage rocks has been the inability to hold in a single rack both a container for powdered baby formula as well as a series of nurser bottles for use of the formula. While many prior shelves can hold either one or the other, the storage and location of both a powder formula container as well as a series of nurser bottles and even baby food jars all in one location in which all three are easily viewed and easily accessible is highly desirable.

Yet another shortcoming of the prior known shelves and racks is the lack of versatility in use of trays or racks. Typically, existing racks and shelves have a fixed number of support areas or receptacles for jars or containers. In the event a mother wishes to store only a smaller number of jars or containers, the same large-size rack or shelf had to be used leaving much of the assembly unfilled and taking up valuable space on the counter in the kitchen or other food mixing area. Therefore, the ability to tailor and modify the size of the storage assembly to the use requirements of the particular family or mother was less than adequate with the prior known devices.

In addition to the above, a shelf or rack which could be sold in knockdown, unassembled form, taking less retail shelf space for the same size assembly, or using the same amount of shelf space but providing a larger shelf or rack when assembled, was also desired, especially in an assembly where the costs were kept competitive and use of material was efficient.

Therefore, there was a need for a storage assembly for jars, bottles, and containers which could overcome the above problems and provide a versatile, inexpensive assembly which could fit the needs of modem mothers and families with young children, as well as other storage needs.

SUMMARY OF THE INVENTION

Accordingly, the present invention provides a storage assembly for jars, bottles, containers and the like, and especially jars of baby food, containers of baby formula, and nurser bottles having interchangeable trays and racks supported on a rotatable base assembly providing a knockdown assembly making efficient use of retail shelf space when sold, providing versatility in size and type of jar, bottle, or container supported, while also providing the ability to hold baby food jars, formula containers, and nurser bottles together in an easily viewed, easily accessible manner.

In one form, the invention is a carousel storage assembly for jars, bottles, containers, and the like comprising a base, a first tray having an article support member rotatably supported on the base on bearings between the base and the first tray, and at least one of a rack and second tray removably supported above the first tray. Each of the rack and second tray includes an article support member having a perimeter and a plurality of legs spaced from one another on the perimeter. The first tray includes a plurality of leg engaging clips for removably receiving the legs from a selected one of the rack and second tray. Each of the clips has a restraining member mounted on a perimeter of the first tray, spaced above the support member, and extending inwardly towards the center of the support member. Each of the clips is also adapted to removably receive a portion of one of the legs under its retaining member such that the selected rack or second tray is mounted above the first tray for rotation therewith with respect to the base.

In this form of the invention, the rack and second tray may be interchangeably supported on the first tray or with the rack on the second tray. Preferably, the legs are bendable with each including a mounting flange at its bottom such that the legs can be flexed to insert and remove the mounting flange from under the clip retaining member as desired. One or more detents can be provided on the mounting flange to help retain the flanges in the clips. In addition, the legs are preferably elongated and have outwardly opening partial cylindrical surfaces.

It is also preferred that the bearings between the base and first tray be held in an annular retainer having a plurality of bearing receiving pockets with the retainer and bearings being received in a recess in the base and between the base and first tray.

Other included features comprise an upstanding ridge at the perimeter of each tray or rack to help retain bottles, jars, or containers on the support surface. In addition, the rack includes a plurality of spaced apertures for receiving and locating articles, such as nurser bottles, therein for support on a first or second tray therebelow when the rack is mounted in the assembly.

In another form of the invention, a carousel storage assembly for jars, bottles, containers, and the like includes a base, a first tray having an article support member rotatably supported on the base on bearings positioned between the base and first tray, and a rack and a pair of second trays each having an article support member and being interchangeably and removably mounted on the first tray and successively stacked on one another. Each of the rack and second trays includes a plurality of legs spaced from one another for supporting the respective rack or second tray above and in registry with the next, lower first tray or second tray therebelow. Each of the first and second trays include a plurality of leg retaining clips in registry with the legs of the rack and second trays. The legs are bendable for flexing, for insertion and removal from the leg retaining clips such that the rack and second trays are adapted for individual mounting and support on and in registry with the first tray as well as successive, removable stacking of the second trays, and rack one above the other on and in registry with the first tray.

Other aspects of the invention include the provision of a tray for supporting articles on a storage assembly for jars, bottles, containers, and the like including an article support member having a perimeter, a plurality of legs extending downwardly at spaced locations from the article support member for engaging and supporting the tray above at least one of another of said trays and base. Each of the legs is bendable for flexing and has a mounting flange adjacent its free end whereby the legs are adapted to be flexed for insertion and removal of the mounting flanges from cooperating leg retaining clips on the other tray or base.

Also, the invention provides a base assembly for rotatably supporting at least one of a tray and rack thereon to form a carousel storage assembly for jars, bottles, containers, or the like. The base assembly includes a base member having an annular rim thereon, a tray having an article support member, a perimeter, and an annular flange received on the rim for rotatably positioning the first tray on the base and a removable plug member received in the rim and flange to hold the base member and the tray together. The tray also includes at least one clip at its perimeter for engaging and retaining a leg of another tray or rack when supported above the tray.

Accordingly, the present invention provides numerous advantages over prior known storage shelves and racks for food jars or containers and the like. The assembly is versatile and allows the use of one or multiple trays or rack thereby allowing a person to assemble successive trays and racks to modify the storage capacity. When used for baby food storage, a mother can start with nurser bottle storage for a newborn baby, move to the use of two baby food jar support trays on a rotatable base for easy access and viewing of stored food, and finally add a top rack on top of the two trays to store nurser bottles and formula all in one location above various baby food jars. Alternately, the storage rack can be used to support nurser bottles separate and apart from the rotatable base and/or carousel storage assembly. In addition, the invention provides storage capacity for a larger number of jars, bottles, and containers than in prior known assemblies, allows simultaneous support of formula containers and nurser bottles as well as baby food jars, all in one assembly and in one location, with easy access to each. Further, the assembly may be disassembled and knocked down and sold in a less space consuming form while material usage allows the assembly to be highly cost competitive.

These and other objects, advantages, purposes, and features of the invention will become more apparent from a study of the following description taken in conjunction with the drawings.

DESCRIPTION OF PREFERRED EMBODIMENT

Figure 1:
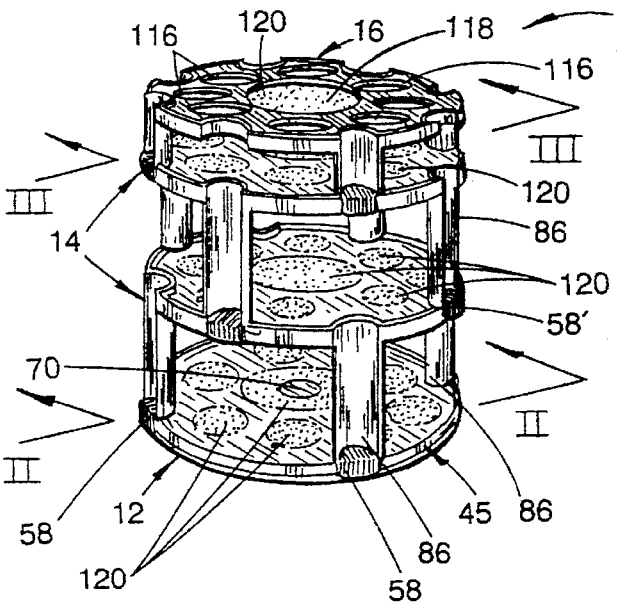
FIG. 1 is a perspective view of a carousel storage assembly incorporating the present invention.
Figure 7:
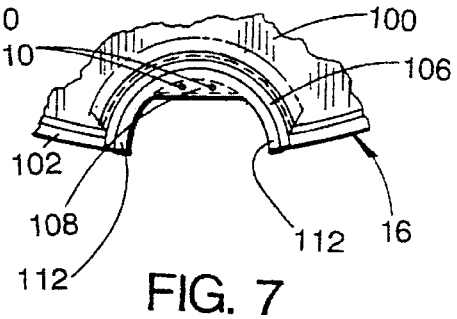
FIG. 7 is a fragmentary bottom plan view of one of the support legs of the top rack of the present invention taken along the plane VII—VII of FIG. 6.

Referring now to the drawings in greater detail, carousel storage assembly 10 includes a base assembly 12, a pair of article support trays 14 removably stacked for interchangeable use on base assembly 12 and a removable top rack 16 which is selectively mountable on top of one of the trays 14 or on base assembly 12 if neither of the trays 14 is in use. The support trays 14 and top racks 16 are each designed as a container support, as described in greater detail hereinafter. Each of the base, support trays and top rack is preferably molded from a resinous plastic material such as high impact polystyrene which has sufficient rigidity and strength to support a full load of jars, bottles, or containers on the storage assembly yet provides sufficient resiliency and flexibility to allow bending of the legs for removable insertion of the trays and rack either alone or together on the base assembly as is more fully described hereinafter.

Figure 8:
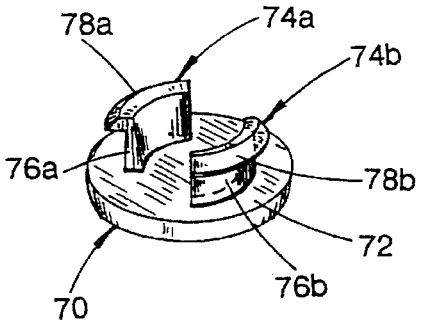
FIG. 8 is a bottom perspective view of the plug member for retaining the base and first tray in rotatable engagement with one another.
Figure 2:
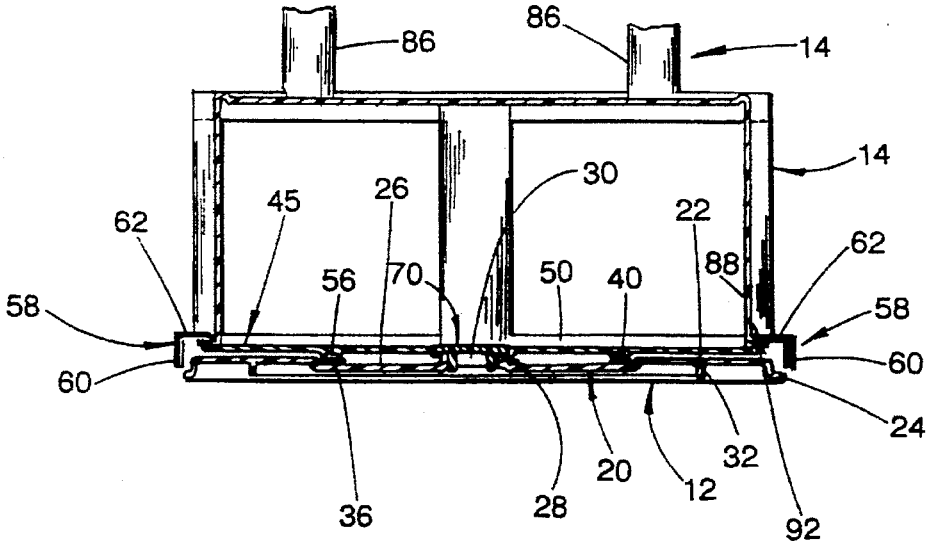
FIG. 2 is a fragmentary, sectional front elevation of a lower portion of the carousel storage assembly of FIG. 1.
Figure 4:
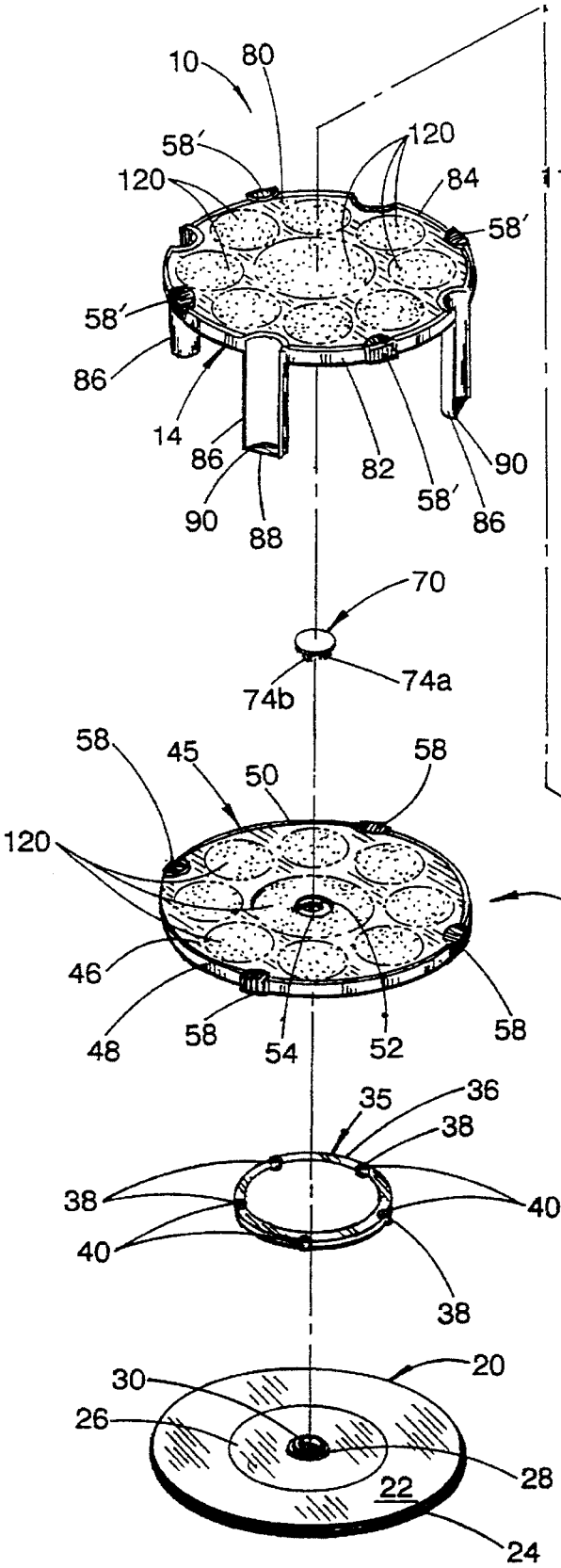
FIG. 4 is an exploded, perspective view of the carousel storage assembly of FIGS. 1–3 illustrating the various parts comprising the assembly.

As is best seen in FIGS. 2, 4, and 8, base assembly 12 includes a circular base member 20 preferably formed from high impact polystyrene and having a top wall 22 and a circular peripheral flange 24 extending radially outwardly therearound and defining an annular periphery. Top surface 22 is recessed to provide an annular bearing receiving recess 26 immediately adjacent a central, upstanding annular rim 28 defining a circular aperture 30 extending through the base member. Base member 20 also includes a downwardly extending annular ridge 32 on its undersurface for additional strength and rigidity. Mounted above base member 20 within annular recess 26 is an annular bearing assembly 35 best seen in FIG. 4. Assembly 35 includes an annular, molded plastic retainer 36 preferably formed from polyethylene and having a rectangular cross section and a series of equally spaced bearing receiving pockets 38 each receiving a stainless steel or other ball bearing 40 therein. The diameter of assembly 35 is slightly smaller than the outside diameter of recess 26 such that the bearings are positioned near the outermost radial position of the recess for proper support of the trays and racks thereabove. If desired, the size of the recess could be increased to position the bearing assembly and especially annular retainer 36 farther radially outward for increased support. Likewise, an additional bearing assembly having a larger diameter could be added outboard of assembly 35 in another recess formed within base member 20 for additional support if desired.

Fitted rotatably over base member 20 on bearing assembly 35 is a first tray 45 also preferably molded from high impact polystyrene. First tray 45 includes a generally planar article support surface 46 having an annular or circular periphery 48 formed by a downwardly extending flange 48.

Figure 11:
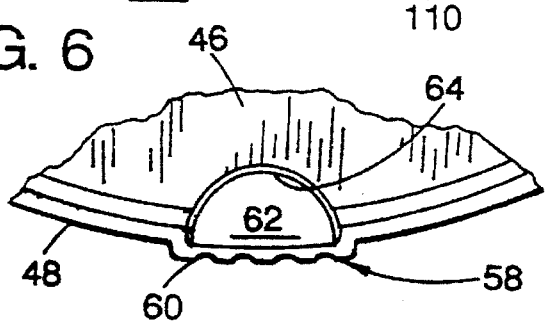
FIG. 11 is a fragmentary, bottom plan view of the underside of the tray or rack at the position of one of the leg retaining clips and taken along line XI—XI of FIG. 5.

The junction between support surface 46 and flange 48 is provided with an annular ridge or lip 50 which extends above surface 46 to help confine jars, bottles, or containers placed on support surface 46 from sliding off the support surface and tray, especially when the tray is rotated on bearing assembly 35. Tray 45 also includes a central, circular aperture 52 within an annular recess 54. Aperture 52 has a diameter slightly larger than the outside diameter of annular rim 28 on base member 20 such that first tray 45 can be telescoped over rim 28 which is received through aperture 52 with its top edge flush with the upper surface of recess 54 as shown in FIG. 2. As is also shown in FIG. 2, first tray 45 includes an annular bearing track 56 on its undersurface, the track having a contoured downwardly facing surface adapted to receive bearings 40 as shown. In addition, at four equally spaced positions around the periphery 48 of tray 45 are leg retaining clips 58 integrally molded with flange 48. As is best seen in FIGS. 1–4 and 11, each leg retaining clip 58 includes a vertically extending wall 60 offset radially outwardly from the remainder of flange 48 and a leg retaining flange 62 which is integral with flange 60 but extends at 90° thereto in a radially inward direction at a position spaced above the top surface of article support member 46 (FIG. 2). The exterior surface of flanges 60, 62 may be formed with ribs or recesses as shown in the drawings for aesthetic purposes. Each of the leg retaining flanges 62 has a semicircular shape while the article support member 46 includes a corresponding, semicircular shaped aperture 64 beneath each of the leg retaining flanges 62 as shown in FIGS. 2 and 11. As will be more fully explained below, leg retaining clips 58 are adapted to receive flanges 88 or 108 from the spaced support legs of the trays or rack to releasably couple the legs to the support clips to allow assembly and disassembly of the carousel storage device as desired.

When fitted together as shown in FIG. 2, first tray 45 and base member 20 are rotatably supported on bearing assembly 35 as guided by the engagement between the edge of recess 54 and annular rim 28. In order to retain the two parts together, however, a retaining plug member 70 (FIGS. 1, 2, 4, and 8) is provided. Plug member 70 is preferably molded from polypropylene and includes a generally planar, circular disk or head 72 having a thickness substantially corresponding to the depth of recess 54 in first tray 45. On the undersurface of disk or head 72 are molded a pair of spaced, retaining legs or flanges **74*a*, 74*b* each of which has a partially circular configuration when viewed from below as shown in FIG. 8. When viewed in vertical section, each retaining flange is generally L-shaped and includes an upstanding wall 76*a*, 76*b* and a radially outwardly projecting flange 78*a*, 78*b* providing a barb or retainer for holding the plug member 70 in base member 20. As is best seen in FIG. 2, when first tray 45 is telescoped over rim 28 of base member 20, with bearing assembly 35 therebetween for rotatable support, plug member 70 is aligned with aperture 52 and inserted in a downward direction from above first tray 45. During insertion, flanges 74*a*, 74*b* flex inwardly until flanges 78*a*, 78*b* pass the bottom surface of rim 28 when they flex outwardly to retain the plug member in position. In this position, the undersurface of disk 72 engages the top edge of rim 28 while the outer edge of the disk extends into recess 54 to prevent vertical movement of first tray 45. Base assembly 12 is thus completed and ready for selective installation of one or a pair of second tray members 14 or top rack 16** as described more fully below.

Figure 9:
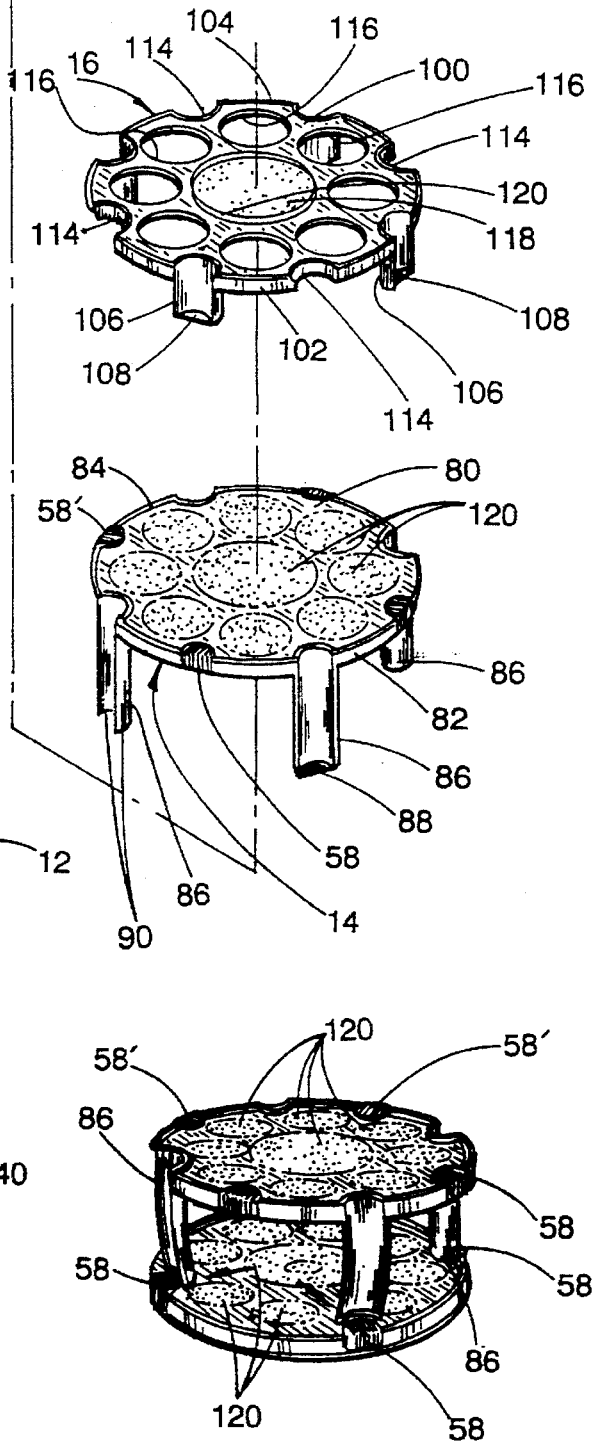
FIG. 9 is a perspective view of the base assembly and one of the trays illustrating insertion and removal of the bendable, flexible legs from the underlying leg retaining clips.
Figure 3:
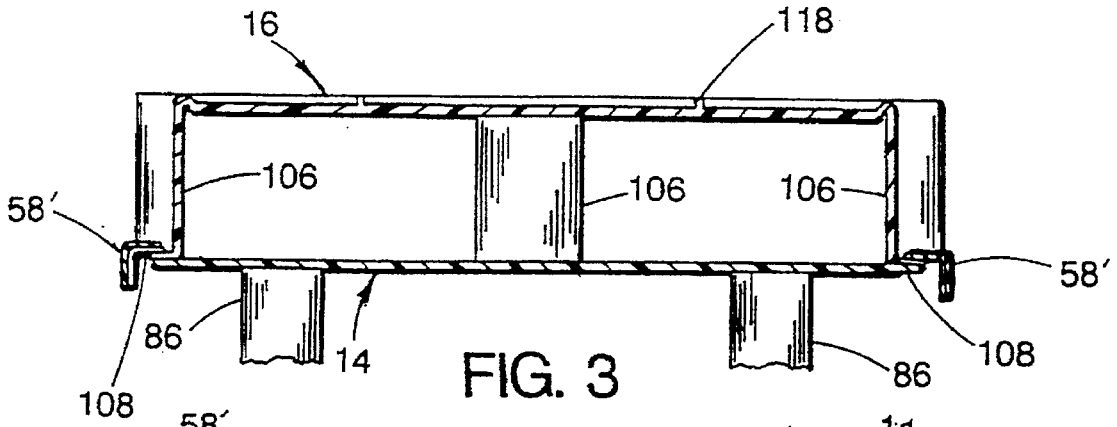
FIG. 3 is a fragmentary, sectional front elevation of the upper portion of the carousel storage assembly of FIG. 1.
Figure 5:
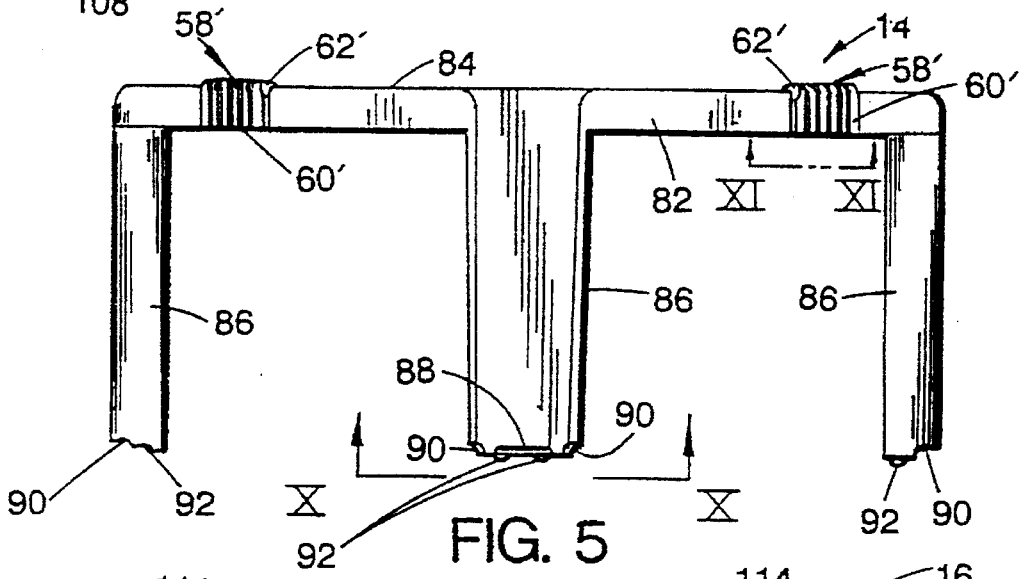
FIG. 5 is a side elevation of one of the interchangeable article support trays used in the assembly of FIGS. 1–4.
Figure 6:
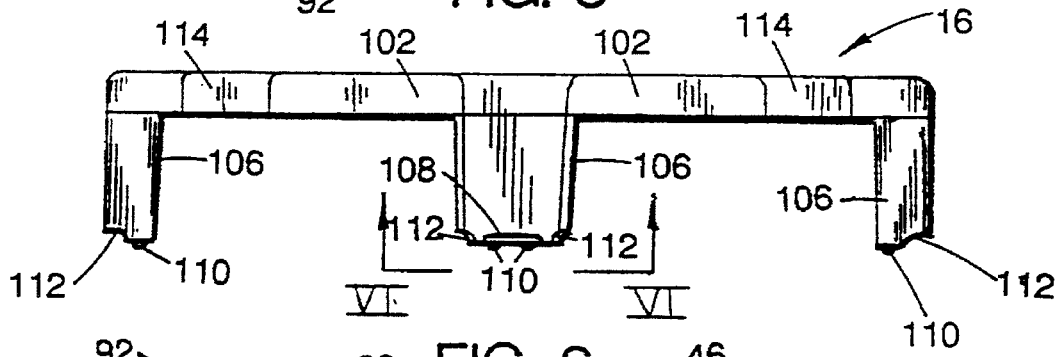
FIG. 6 is a side elevation of the top rack for use in the storage assembly of FIGS. 1–4.
Figure 10:
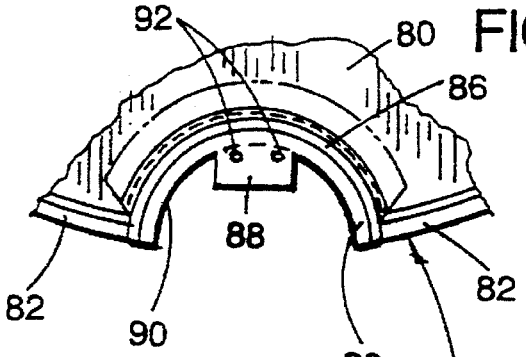
FIG. 10 is a fragmentary, bottom plan view of one of the legs from a tray in the assembly taken along plane X—X of FIG. 5.

With reference to FIGS. 1, 4, 5, 7 and 9–11, each second tray 14 is preferably also molded from high impact polystyrene and includes a generally planar article support member 80 having an annular, downwardly extending outer flange 82 at its generally circular periphery. The junction between flange 82 and support member 80 defines an upstanding ridge or lip 84 which extends higher than support member 80 and serves to retain bottles, jars, or containers thereon, especially during rotation of the carousel assembly in the same fashion as does lip or ridge 50 on first tray 45. At spaced locations around the circular periphery of second tray 14 are integrally molded a plurality of, preferably four, support legs 86 each having a semicircular configuration in cross section. The closed surface of the semicircular leg extends radially inwardly to define a semicircular aperture at the periphery of article support member 80 while the opening to the semicylindrical leg 86 extends outwardly as shown. At the bottom of each support leg 86 is a mounting flange 88 generally at right angles to the axis of the semicylindrical leg 86 as shown in FIGS. 4, 5, and 10. The lower edges of the semicylindrical leg surface are slightly recessed as shown at 90 to receive ridge or lip 50 or 84 when the leg is assembled as described below. On the downwardly facing surface of mounting flange 88 are a pair of spaced, hemispherical projections or detents 92 spaced slightly outside the position of the inner surface of leg 88 as shown in FIG. 10. As is shown in FIG. 2, when mounting flange 88 is received under retaining flange 62 of leg retaining clip 58, detents 92 project into aperture 64 such that the detents resist withdrawal of the mounting flange 88 from under clip 58 by engaging the edge of the aperture should the leg be moved radially inwardly. However, with sufficient force, the hemispherical detents 92 will ride up over the edge of aperture 64 causing a slight upward flexure of retaining flange 62 and allowing the removal of the flange and leg from under clip 58.

As is best shown in FIG. 9, the semicylindrical legs 86 have a sufficient length and are formed from a sufficiently resilient material to allow radial inward bending and flexing such that the mounting flange 88 can be inserted under clip 58. Thus, since each of the legs 86 are positioned to correspond to the position of one of the clips 58 on first tray 45, the bendable, flexible legs may be flexed inwardly to position the edge of mounting flange 88 under retaining flange 62 followed by movement of the leg outwardly in the direction of the arrows shown in FIG. 9 to force the detents 92 between flange 62 and the edge of aperture 64 until they drop into place and the leg is received completely under the clip 58. The semicircular edge of flange 62 matches the inner diameter of the semicylindrical leg such that circumferential movement of the leg is substantially eliminated. As above, when removal of the second tray 14 from first tray 45 is desired, the leg 86 may be flexed inwardly as shown in FIG. 9 to force the detents 92 out of aperture 64 and allow removal of the legs.

The annular flange 82 of each second tray 14 also includes leg retaining clips 58' substantially similar to those included on first tray 45 such that tray 14 can receive a second tray 14 thereabove in stacked succession or, alternately, a top rack 16 as described below. Clips 58' include flanges 60', 62' substantially identical to flanges 60, 62 and which operate in a manner similar to that described above for releasable, removable receipt of the support legs of another first tray 14 or the top rack.

As is best seen in FIGS. 3, 4, 6, and 7, rack 16 includes an article support member 100 having a downwardly extending generally annular flange 102 at its outer, generally circular periphery. The junction between flange 102 and support member 100 provides an upstanding ridge or lip 104 which is higher than support surface 100 and helps confine any article supported on support member 100 in the same manner as do ridges/lips 50, 84 described above. Rack 16 is also preferably molded from high impact polystyrene and includes four support legs 106 at equally spaced positions around the periphery and formed with annular flange 102. Legs 106 are similar to support legs 86 on tray 14 but are approximately half as long such that rack 16 is supported a distance above tray 14 or 45 approximately one-half the distance, which trays 14 are supported above tray 45 or above one another. As explained below, this allows rack 16 to support the middle areas of any containers inserted therein. Each leg 106 also has a semicylindrical shape which opens outwardly and includes a semicircular cross section as do legs 88. At the bottom of leg 106 is a mounting flange 108 (FIG. 7) which is slightly wider and has the shape of a section of a circle and is positioned at the inner back of each leg. Spaced hemispherical projections or detents 110 are provided on the bottom surface of mounting flange 108 in the same manner as detents 92 on mounting flange 88. In addition, the sides of leg 106 adjacent mounting flange 108 are cut away to form recesses 112 for receipt of lip 84 or 50 when legs 106 are engaged with leg retaining clips 58 or 58'.

Spaced equidistantly intermediate legs 106 are semicircular recesses 114 formed in annular flange 102. Recesses 114 are adapted to receive legs 86 such that rack 16 may be nested under or within tray 14 when the carousel assembly is packed for shipping and storage in a container. Thus, recesses 114 allow space saving storage of the carousel storage assembly until assembly is desired after purchase.

In addition, article support member 100 includes a series of eight circular apertures 116 spaced equidistantly near the outer periphery thereof for receiving nurser bottles or other containers therethrough for support atop either tray 45 or 14 when rack 16 is mounted thereon. In addition, article support surface 100 includes an annular rim or ridge 118 which defines a circular support surface for another container such as a container of powdered baby formula or the like in the center of and adjacent the series of nurser bottles when received in apertures 116.

In addition, each of the first tray 45 and second trays 14 preferably includes a series of textured surface areas 120 in circular areas corresponding in shape and location to the circular apertures 116 in rack 16 and the center support surface of rack 16 located centered within apertures 116. These textured areas which may have roughened, raised surfaces, formed during molding of the trays, provide a visual location guide for support of containers on each tray such as smaller baby food jars or nurser bottles and larger powdered baby formula containers which can be received in the center of each tray. Areas 120 are also located in alignment and in registry with apertures 116 and the support area defined by rim or ridge 118 when rack 16 is mounted above either tray 14 or tray 45 depending on the desired number of trays and racks mounted on base assembly 12. Therefore, when a nurser bottle is received through aperture 116, it is supported on textured surface 120 which helps prevent sliding and movement of the base of the nurser bottle during rotation of the assembly. Alternately, baby food jars or other containers can be located on the textured areas 120 even if rack 16 is not present.

As will also be apparent, legs 106 on rack 16 are bendable and flexible like legs 86 such that assembly of rack 16 on either tray 45 or tray 14 via mounting flange 108 and leg retaining clips 58, 58' can occur in the manner described above for tray 14 on first tray 45 or another tray 14.

As will now be apparent, the carousel storage assembly 10 can be sold while packaged in a knockdown, unassembled condition with trays 14 and rack 16 nested within one another. Typically, base assembly 12 will be sold with first tray 45, bearing assembly 35 and base member 20 already assembled via plug retainer 70 in the manner described above. When assembly of the carousel storage assembly is desired after purchase, one or more of the trays 14 and rack 16 may be assembled atop first tray 45 or not at all. Thus, if it is desired to use the base assembly 45 to support a few baby food jars or containers, or the like, trays 14 and rack 16 can be left off the assembly and stored until needed. As additional food space or storage is required, second trays 14 can be successively added to tray 45 with or without rack 16 on top of the second trays 14. Alternately, the second one of trays 14 can be omitted with rack 16 placed atop trays 14 which, in turn, is mounted on tray 45. A yet further modification is to assemble rack 16 directly on tray 45 such that the carousel storage assembly serves to support nurser bottles in apertures 116 and a baby formula container centrally thereon in a rotatable manner without providing any storage space for baby food jars. Accordingly, trays 14 and rack 16 may be stacked selectively and successively atop tray 45 using one, two or all three components as desired. Further, the components are interchangeable such that legs 86 or 106 can be received in either leg retaining clips 58 or 58' as desired.

As will also be apparent, any of the separate trays 14, rack 16 or base assembly 12 can be used separate and apart from the other elements and can be placed in a stationary manner on a support surface such as a kitchen counter, work bench, or the like for use in such manner by themselves. Alternately, trays 14 and rack 16 can be stacked successively one on the other as shown in FIG. 1 but without supporting them on the rotatable base assembly 12 thereby making a stationary container support assembly. Likewise, base assembly 12 can be used without any of trays 14 and rack 16 as a rotatable storage assembly for supporting jars, bottles, or the like, alone.

While several forms of the invention have been shown and described, other forms will now be apparent to those skilled in the art. Therefore, it will be understood that the embodiments shown in the drawings and described above are merely for illustrative purposes, and are not intended to limit the scope of the invention which is defined by the claims which follow.

The embodiments of the invention in which an exclusive property or privilege is claimed are as follows:

1. A carousel storage kit for jars, bottles, and other containers comprising:

a base;

a first tray having an article support member adapted to be rotatably supported on said base;

at least one rack adapted to be removably supported above said first tray, and including an article support member having a perimeter and a plurality of legs spaced from one another along said perimeter; each of said legs having a radially outwardly extending mounting flange adjacent the lower end thereof;

at least one second tray adapted to be removably supported above said first tray, and including an article support member having a perimeter and a plurality of legs spaced from one another along said perimeter; each of said legs having a radially outwardly extending mounting flange adjacent the lower end thereof; and said first tray including a plurality of leg engaging clips adapted for removably receiving therein said legs from a selected one of said rack and said second tray; said clips each having a retaining member mounted along the perimeter of said first tray, spaced above said support member, and extending radially inwardly toward the center of said support member; each of said clips being adapted to removably receive therein the mounting flange on an associated portion of one of said legs whereby said selected one of said rack and said second tray is detachably mounted above said first tray for rotation therewith with respect to said base.

2. The carousel storage assembly kit of claim 1 wherein said second tray includes a perimeter and a plurality of said leg engaging clips along said perimeter whereby said rack and said second tray are interchangeably supported on said first tray and on one another.

3. The carousel storage assembly kit of claim 2 wherein said legs of said second tray are engaged with said clips on said first tray, and said legs of said rack are engaged with said clips on said second tray whereby said second tray and said rack are stacked successively on said first tray.

4. The carousel storage assembly kit of claim 2 wherein said legs of said rack are engaged with said clips on said first tray whereby said rack is mounted above said first tray.

5. The carousel storage assembly kit of claim 2 wherein said legs of said second tray are engaged with said clips on said first tray whereby said second tray is mounted above said first tray.

6. The carousel storage assembly kit of claim 1 wherein said legs are bendable and each being adapted to flex such that said mounting flange can be inserted and removed from under said clip retaining member.

7. The carousel storage assembly kit of claim 6 wherein said leg engaging clips on said first tray include an aperture through said article support member beneath said retaining member; said mounting flange on each of said legs including at least one projecting detent for receipt in said aperture when received under said retaining member to retain said mounting flange in said clip.

8. The carousel storage assembly kit of claim 6 including a detent on each of said mounting flanges to retain said mounting flange in said clip.

9. The carousel storage assembly kit of claim 1 wherein each of said legs is elongated, has an axis of elongation, and a partially cylindrical surface extending parallel to said axis of elongation.

10. The carousel storage assembly kit of claim 9 wherein said partially cylindrical legs each have an open side facing outwardly away from the center of said support member of said respective rack and second tray.

11. The carousel storage assembly kit of claim 1 including an annular retainer having a plurality of bearing receiving pockets therein, said bearings being rotatably mounted in said retainer pockets, said retainer and bearings being received in a recess in said base and between said base and said first tray.

12. The carousel storage kit of claim 1 including an annular rim on said base; said first tray including an annular flange received on said rim for rotatably positioning said first tray on said base; and a removable plug member received in said rim and flange, said plug member having flexible upstanding walls, said walls having a radially outwardly projecting flange for retaining said plug member in said base thereby holding said base and said first tray together.

13. The carousel storage assembly kit of claim 1 wherein said rack includes a plurality of spaced apertures therethrough for receiving and locating articles therein for support.

14. The carousel storage assembly kit of claim 13 wherein said first tray and said second tray each include textured surface areas on their respective article support members, each of said textured surface areas being aligned with one of said spaced apertures in said rack.

15. The carousel storage assembly kit of claim 1 wherein each of said first tray, second tray and rack have a generally circular perimeter.

16. The carousel storage assembly kit of claim 1 wherein each of said first tray and said second tray include an upstanding ridge at said perimeter of said article support member to help retain items supported thereon.

17. The carousel storage assembly of claim 1 wherein said legs of said rack and said second tray are integrally formed with said rack and second tray.

18. A base assembly for rotatably supporting a tray or a rack thereon to form a carousel storage assembly for jars, bottles and containers, said base assembly comprising:

a base member having an annular rim thereon;

a tray having an article support member, a perimeter, and an annular flange for rotatably positioning said tray on said base member;

a removable plug member having flexible upstanding walls, said walls having a radially outwardly projecting flange for retaining said plug member in said base to hold said base member and tray together; and said tray including at least one clip at said perimeter for engaging and retaining a leg.

19. The base assembly of claim 18 wherein said plug member includes a circular head and at least one barbed retaining flange engaging said base member to retain said tray thereon.

20. The base assembly of claim 19 wherein said annular flange on said tray is recessed such that said circular head on said plug member is received flush with said article support member.

21. A storage assembly for jars, bottles, and other containers comprising:

a base;

a tray having an article support member supported on said base;

at least on container support removably supported above said tray, and including an article support member having an article support surface and a perimeter and a plurality of legs spaced from one another along said perimeter;

each of said legs having an upper end thereof fixedly connected to said container support, a lower end with a radially outwardly extending mounting flange, and being elastically bendable in a radial direction; and said tray including a plurality of clips, each having a retaining member mounted along the perimeter of said tray, spaced above said support member, and extending radially inwardly toward the center of said support member; each of said clips removably receiving therein said mounting flange of an associated one of said legs upon radial bending of said associated leg, whereby said container support is detachably mounted above said tray.

22. The storage assembly of claim 21 wherein each of said legs is elongated, has an axis of elongation, and a partially cylindrical surface extending parallel to said axis of elongation.

23. The storage assembly of claim 22 wherein said partially cylindrical legs each have an open side facing outwardly away from the center of said support member of said container support.

24. The storage assembly of claim 23 wherein said container support has an article support surface which includes a plurality of spaced apertures therethrough for receiving and locating articles therein.

25. The storage assembly of claim 24 including an annular ridge on said article support surface for retaining and locating a container thereon.

26. The storage assembly of claim 25 wherein said article support surface has textured surface areas thereon.

27. The storage assembly of claim 26 including an upstanding ridge at said perimeter of said article support member to help retain items supported thereon.

28. The storage assembly of claim 27 including a generally circular perimeter.

29. A storage kit for jars, bottles, and other containers comprising:

a tray having an article support member;

at least one container support removably supported above said tray, and including an article support member having a perimeter and a plurality of legs spaced apart from one another along said perimeter, each of said legs having an upper end thereof fixedly connected to said container support, a lower end with a radially outwardly extending mounting flange, said legs being elastically bendable in a radial direction;

said tray including a plurality of clips, each having a retaining member mounted along the perimeter of said tray, spaced above said support member, and extending radially inwardly toward the center of said support member, each of said clips removably receiving therein said mounting flange of an associated one of said legs upon bending of said associated leg in a radial direction; and each of said flanges including a detent to retain said mounting flange in said clip.

30. The storage kit of claim 29 wherein each of said clips includes an aperture through said article support member beneath said retaining member; said projecting detent on said mounting flange on each of said legs being configured for receipt in said aperture when received under said retaining member to retain said mounting flange in said clip.

31. The storage kit of claim 30 including an annular rim on said base; said tray including an annular flange received on said rim for rotatably positioning said tray on said base; and a removable plug member received in said rim and flange to hold said base and tray together.

32. The storage kit of claim 31 wherein said container support is a rack including a plurality of spaced apertures therethrough for receiving and locating articles therein for support on said tray therebelow when said rack is mounted thereon.

33. The storage kit of claim 32 wherein said tray includes textured surface areas on said article support member, said textured surface areas being aligned with said spaced apertures in said rack.

34. The storage kit of claim 33 wherein said tray includes an upstanding ridge at said perimeter of said article support member to help retain items supported thereon.

35. The storage kit of claim 34 wherein said rack includes a plurality of spaced apertures therethrough for receiving and locating articles therein for support on said tray therebelow when said rack is mounted thereon.

36. The storage kit of claim 35 wherein said tray includes an upstanding ridge at said perimeter of said article support member to help retain items supported thereon.

* * * * *

UNITED STATES PATENT AND TRADEMARK OFFICE

CERTIFICATE OF CORRECTION

PATENT NO. : 5,641,080
DATED : June 24, 1997
INVENTOR(S) : David C. Humphrey et al It is certified that error appears in the above-identified patent and that said Letters Patent is hereby corrected as shown below:

Column 1, line 28; "rocks" should be --racks--.

Column 1, line 58; "modem" should be --modern--.

Column 9, claim 2, line 10; delete "assembly".

Column 9, claim 3, line 15; delete "assembly".

Column 9, claim 4, line 20; delete "assembly".

Column 9, claim 5, line 23; delete "assembly".

Column 9, claim 6, line 27; delete "assembly".

Column 9, claim 7, line 31; delete "assembly".

UNITED STATES PATENT AND TRADEMARK OFFICE

CERTIFICATE OF CORRECTION

PATENT NO. : 5,641,080

DATED : June 24, 1997

INVENTOR(S) : David C. Humphrey et al

It is certified that error appears in the above-identified patent and that said Letters Patent is hereby corrected as shown below:

Column 9, claim 8, line 38; delete "assembly".

Column 9, claim 9, line 41; delete "assembly".

Column 9, claim 10, line 45; delete "assembly".

Column 9, claim 11, line 49; delete "assembly".

Column 9, claim 13, line 64; delete "assembly".

Column 10, claim 14, line 1; delete --assembly--.

Column 10, claim 15, line 6; delete --assembly--.

Column 10, claim 16, line 9; delete --assembly--.

Column 10, claim 21, line 42; "on" should be --one--.

Signed and Sealed this

Ninth Day of December, 1997

*Attest:*

Bruce Lehman

BRUCE LEHMAN

*Attesting Officer*

*Commissioner of Patents and Trademarks*